US011542899B2

(12) United States Patent
Delleree et al.

(10) Patent No.: US 11,542,899 B2
(45) Date of Patent: Jan. 3, 2023

(54) ION SENSING FOR VAPOR START CONTROL

(71) Applicants: Matthew M Delleree, Brghton, MI (US); James J Daley, Jackson, MI (US); Roger C Sager, Munith, MI (US); Joseph M Dekar, Jackson, MI (US)

(72) Inventors: Matthew M Delleree, Brghton, MI (US); James J Daley, Jackson, MI (US); Roger C Sager, Munith, MI (US); Joseph M Dekar, Jackson, MI (US)

( * ) Notice: Subject to any disclaimer, the term of this patent is extended or adjusted under 35 U.S.C. 154(b) by 0 days.

(21) Appl. No.: 17/106,596

(22) Filed: Nov. 30, 2020

(65) Prior Publication Data

US 2022/0170434 A1 Jun. 2, 2022

(51) Int. Cl.
*F02M 25/08* (2006.01)
*F02D 41/00* (2006.01)
*F02D 41/06* (2006.01)

(52) U.S. Cl.
CPC ..... *F02M 25/089* (2013.01); *F02M 25/0854* (2013.01); *F02D 41/004* (2013.01); *F02D 41/064* (2013.01); *F02M 25/0836* (2013.01)

(58) Field of Classification Search
CPC ..... F02M 25/089; F02M 25/0854; F02M 25/0836; F02D 41/004; F02D 41/064
See application file for complete search history.

(56) References Cited

U.S. PATENT DOCUMENTS 5,769,049 A * 6/1998 Nytomt ..... F02D 35/021 123/435
6,029,627 A * 2/2000 VanDyne ..... F02D 41/22 123/435
6,185,500 B1 * 2/2001 Ketterer ..... F02P 17/12 701/111
6,666,021 B1 * 12/2003 Lewis ..... F02M 26/47 60/289
6,832,472 B2 * 12/2004 Huang ..... F02D 35/021 123/406.26
6,848,421 B1 * 2/2005 Karau ..... F02P 5/1512 123/406.22
6,980,903 B2 * 12/2005 Daniels ..... F01N 3/2006 701/108

(Continued)

*Primary Examiner* — Phutthiwat Wongwian
*Assistant Examiner* — Susan E Scharpf
(74) *Attorney, Agent, or Firm* — Ralph E. Smith

(57) ABSTRACT

An evaporative emissions (EVAP) system for an engine of a vehicle includes an ion sensing system configured to measure a fuel/air ratio (FAR) within cylinders of the engine and a controller configured to, during an engine cold start period, perform open-loop lambda control of the engine including obtaining, from the ion sensing system, the measured FAR within the cylinders of the engine, comparing the measured FAR within the cylinders of the engine to a target FAR within cylinders of the engine, and based on the comparing, adjusting operation of at least one of the EVAP system and fuel injectors of the engine to maintain a stoichiometric operation of the engine, wherein the use of the ion sensing system for open-loop lambda control of the engine eliminates the need for a hydrocarbon (HC) sensor in the EVAP system.

6 Claims, 3 Drawing Sheets

(56) References Cited

U.S. PATENT DOCUMENTS

| | | | | |
|---|---|---|---|---|
| 6,993,960 | B2 * | 2/2006 | Benson | F23N 1/022 73/112.01 |
| 7,426,926 | B2 * | 9/2008 | Husak | F02D 41/062 123/674 |
| 7,603,226 | B2 * | 10/2009 | Henein | F02D 41/1462 701/109 |
| 7,707,992 | B2 * | 5/2010 | VanDyne | F02D 35/021 123/435 |
| 8,490,598 | B2 * | 7/2013 | Qu | F02P 15/10 123/406.2 |
| 9,879,623 | B2 * | 1/2018 | Dekar | F02M 25/0854 |
| 10,054,067 | B2 * | 8/2018 | Badawy | F02D 41/1461 |
| 10,247,116 | B2 * | 4/2019 | Dekar | F02N 99/008 |
| 2007/0215111 | A1 * | 9/2007 | Surnilla | F02D 19/061 123/431 |
| 2015/0075503 | A1 * | 3/2015 | Surnilla | F02D 41/123 123/520 |
| 2017/0082038 | A1 * | 3/2017 | Dudar | F02M 25/0836 |
| 2019/0234294 | A1 * | 8/2019 | Sager | F02M 25/0836 |

* cited by examiner

ION SENSING FOR VAPOR START CONTROL

FIELD

The present application generally relates to evaporative emissions (EVAP) systems and, more particularly, to an EVAP system including an in-cylinder ion sensing system vapor start control.

BACKGROUND

Conventional evaporative emissions (EVAP) systems include a vapor canister and vapor transport lines. The vapor canister traps fuel vapor that evaporates from liquid fuel (e.g., gasoline) stored in a fuel tank of the vehicle. Engine vacuum is typically utilized to deliver the fuel vapor from the vapor canister to the engine through the vapor transport lines and into intake ports of the engine. The specific composition or concentration of the fuel vapor, however, is unknown. As a result, EVAP systems have been developed that utilize a hydrocarbon (HC) sensor for measuring the amount of fuel vapor being provided to the engine. These HC sensors, however, are expensive. Thus, while such EVAP systems do work well for their intended purpose, there remains a need for improvement in the relevant art.

SUMMARY

According to one example aspect of the invention, an evaporative emissions (EVAP) system for an engine of a vehicle is presented. In one exemplary implementation, the EVAP system comprises an ion sensing system configured to measure a fuel/air ratio (FAR) within cylinders of the engine, and a controller configured to, during an engine cold start period, perform open-loop lambda control of the engine including: obtaining, from the ion sensing system, the measured FAR within the cylinders of the engine, comparing the measured FAR within the cylinders of the engine to a target FAR within cylinders of the engine, and based on the comparing, adjusting operation of at least one of the EVAP system and fuel injectors of the engine to maintain a stoichiometric operation of the engine, wherein the use of the ion sensing system for open-loop lambda control of the engine eliminates the need for a hydrocarbon (HC) sensor in the EVAP system.

In some implementations, the engine cold start period is defined from a start of the engine until one or more oxygen (O2) sensors in an exhaust treatment system of the engine have reached an acceptable temperature. In some implementations, the controller is further configured to, after the engine cold start period, perform only closed-loop lambda control of the engine based on measurements from the one or more O2 sensors. In some implementations, the controller is further configured to, after the engine cold start period, perform a combination of ion sensing system based on O2 sensor based lambda control of the engine.

In some implementations, the EVAP system further comprises a vapor canister that stores fuel vapor and one or more purge valves proximate to the cylinders of the engine that control the flow of fuel vapor from the vapor canister to the engine, and the controller is configured to maintain stoichiometric operation of the engine by controlling the one or more purge valves to deliver fuel vapor to the engine. In some implementations, the controller is configured to maintain stoichiometric operation of the engine by controlling pulse widths of the fuel injectors when fuel vapor delivery by the EVAP system is insufficient for maintaining stoichiometric operation of the engine. In some implementations, the ion sensing system is also associated with knock/misfire detection and mitigation features of the engine. In some implementations, the engine is a twin-turbocharged six-cylinder engine.

According to another example aspect of the invention, a method for controlling an EVAP system of an engine of a vehicle during and after engine cold starts is presented. In one exemplary implementation, the method comprises detecting, by a controller of the vehicle, whether an engine cold start period and, in response to detecting the engine cold start period, performing, by the controller, open-loop lambda control of the engine including: obtaining, by the controller and from an ion sensing system, a measured FAR within the cylinders of the engine, comparing, by the controller, the measured FAR within the cylinders of the engine to a target FAR within cylinders of the engine, and based on the comparing, adjusting, by the controller, operation of at least one of the EVAP system and fuel injectors of the engine to maintain a stoichiometric operation of the engine, wherein using the ion sensing system for open-loop lambda control of the engine eliminates the need for a hydrocarbon (HC) sensor in the EVAP system.

In some implementations, the engine cold start period is defined from a start of the engine until one or more O2 sensors in an exhaust treatment system of the engine have reached an acceptable temperature. In some implementations, the method further comprises after the engine cold start period, performing, by the controller, only closed-loop lambda control of the engine based on measurements from the one or more O2 sensors. In some implementations, the method further comprises, after the engine cold start period, perform a combination of ion sensing system based on O2 sensor based lambda control of the engine.

In some implementations, the EVAP system further comprises a vapor canister that stores fuel vapor and one or more purge valves proximate to the cylinders of the engine that control the flow of fuel vapor from the vapor canister to the engine, and maintaining stoichiometric operation of the engine comprises controlling, by the controller, the one or more purge valves to deliver fuel vapor to the engine. In some implementations, maintaining stoichiometric operation of the engine comprises controlling, by the controller, pulse widths of the fuel injectors when fuel vapor delivery by the EVAP system is insufficient for maintaining stoichiometric operation of the engine. In some implementations, the ion sensing system is also associated with knock/misfire detection and mitigation features of the engine. In some implementations, the engine is a twin-turbocharged six-cylinder engine.

Further areas of applicability of the teachings of the present disclosure will become apparent from the detailed description, claims and the drawings provided hereinafter, wherein like reference numerals refer to like features throughout the several views of the drawings. It should be understood that the detailed description, including disclosed embodiments and drawings referenced therein, are merely exemplary in nature intended for purposes of illustration only and are not intended to limit the scope of the present disclosure, its application or uses. Thus, variations that do not depart from the gist of the present disclosure are intended to be within the scope of the present disclosure.

DETAILED DESCRIPTION

As previously discussed, conventional evaporative emissions (EVAP) systems utilize a hydrocarbon (HC) sensor to measure fuel vapor being provided to the engine. These HC sensors, however, are very expensive. Accordingly, improved EVAP systems are presented. These EVAP systems optionally include a purge pump configured to pump fuel vapor that is captured in a vapor canister to the engine and also include an in-cylinder ion sensing system to determine an in-cylinder fuel/air ratio (FAR) for EVAP system adjustment and/or fuel injector pulse width adjustment during engine cold start open-loop lambda control (i.e., before closed-loop lambda control is available). The term "lambda control" refers to adjusting the engine's FAR, which is typically performed in a closed-loop manner based on oxygen (O2) sensors in an exhaust system. During cold starts, however, these O2 sensors have not yet warmed up and thus their measurements could be inaccurate.

Engine emissions are also typically the greatest during engine cold starts. This is due to the fact that, during engine cold starts, engine components (lubricating fluids, catalysts, etc.) have not reached their optimal operating temperatures. By merely removing the above-described HC sensor, open-loop lambda control would not be achievable, which could result in increased emissions during engine cold starts. The use of the ion sensing system for in-cylinder FAR determination allows for fuel vapor to be combusted during open-loop lambda control after engine cold starts, which increases combustion and decreases engine emissions (HC, nitrogen oxides (NOx), carbon monoxide (CO), etc.), in addition to warming up the engine components faster.

Figure 1:
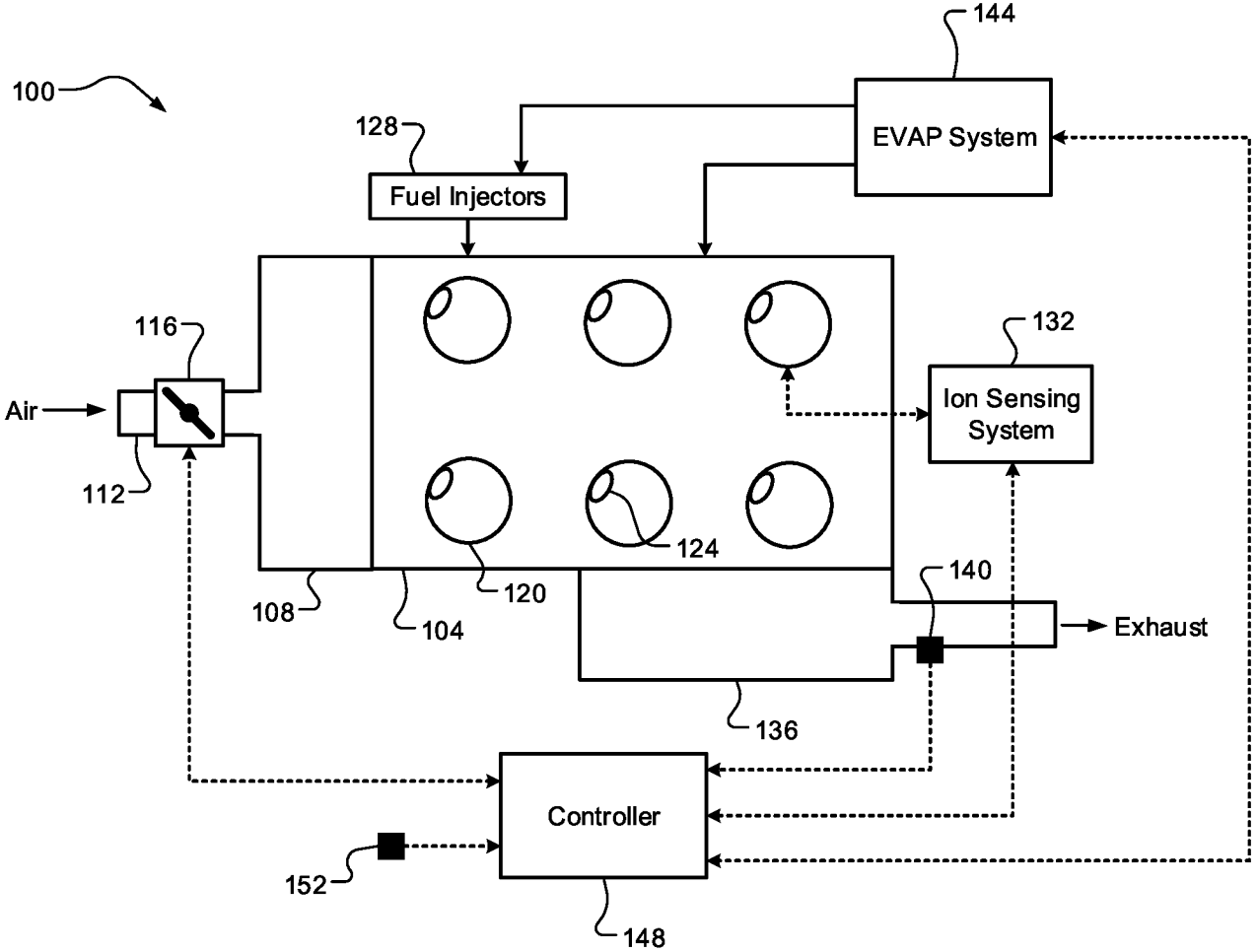
FIG. 1 is a diagram of an example vehicle including an evaporative emissions (EVAP) system according to the principles of the present disclosure.

Referring now to FIG. 1, an example vehicle 100 is illustrated. The vehicle 100 includes an engine 104 that is configured to combust an air/fuel mixture to generate drive torque. The engine draws air into an intake manifold 108 through an induction system 112 that is regulated by a throttle valve 116. The air in the intake manifold 108 is distributed to a plurality of cylinders 120 via respective intake ports 124. While six cylinders are shown, the engine 104 could have any number of cylinders. Fuel injectors 128 are configured to inject liquid fuel (e.g., gasoline) via the intake ports 124 (port fuel injection) or directly into the cylinders 120 (direct fuel injection). While not shown, it will be appreciated that the engine 104 could include other components, such as a boost system (supercharger, turbocharger, etc.). In one exemplary implementation, the engine 104 is a twin-turbocharged six-cylinder engine. Intake valves (not shown) control the flow of the air or air mixture (air/fuel, air/exhaust gas, etc.) into the cylinders 120.

The air/fuel mixture is compressed by pistons (not shown) within the cylinders 120 and combusted (e.g., by spark plugs (not shown)) to drive the pistons, which rotate a crankshaft (not shown) to generate drive torque. An in-cylinder ion sensing system 132 is configured to measure combustion efficiency. The ion sensing system 132 could be part of a larger spark ignition system (not shown) and is configured to measure current flow in a post-combustion ion trail between spark plug electrodes. The term "ion sensing" refers to the principle that electrical current flow in an ionized gas is proportional to the flame electrical conductivity. The ion sensing system 132 is typically utilized for accurate and reliable knock/misfire detection and mitigation (i.e., no ions are created in the presence of a misfire) compared to other methods (e.g., crankshaft monitoring).

Exhaust gas resulting from combustion is expelled from the cylinders 120 via exhaust valves/ports (not shown) and into an exhaust treatment system 136. The exhaust treatment system 136 treats the exhaust gas before releasing it into the atmosphere. The exhaust treatment system 136 also comprises one or more O2 sensors 140 that are each configured to measure an oxygen concentration of the exhaust gas, such as upstream and downstream of a three-way catalytic converter (not shown) of the exhaust treatment system 136. An EVAP system 144 selectively provides fuel vapor to the engine 104 via the intake ports 124, such as during engine cold starts. While delivery via the intake ports 124 is shown and discussed herein, it will be appreciated that the fuel vapor could be delivered to the engine 104 directly into the cylinders 120. The EVAP system 144 includes an optional purge pump (not shown) and an HC sensor (not shown). The EVAP system 144 is controlled by a controller 148.

The controller 148 is any suitable controller or control unit for communicating with and commanding the EVAP system 144. While shown as separate from the EVAP system 144, it will be appreciated that the controller 148 could be considered to be part of the EVAP system 144. In one exemplary implementation, the controller 148 includes one or more processors and a non-transitory memory storing a set of instructions that, when executed by the one or more processors, cause the controller 148 to perform a specific fuel vapor delivery technique. The controller 148 is also configured to receive information from one or more vehicle sensors 152 (i.e., separate from the O2 sensor(s) 140). Examples of the vehicle sensors 152 include an ambient pressure sensor, an altitude or barometric pressure sensor, an engine coolant temperature sensor, and a key-on sensor.

Figure 2:
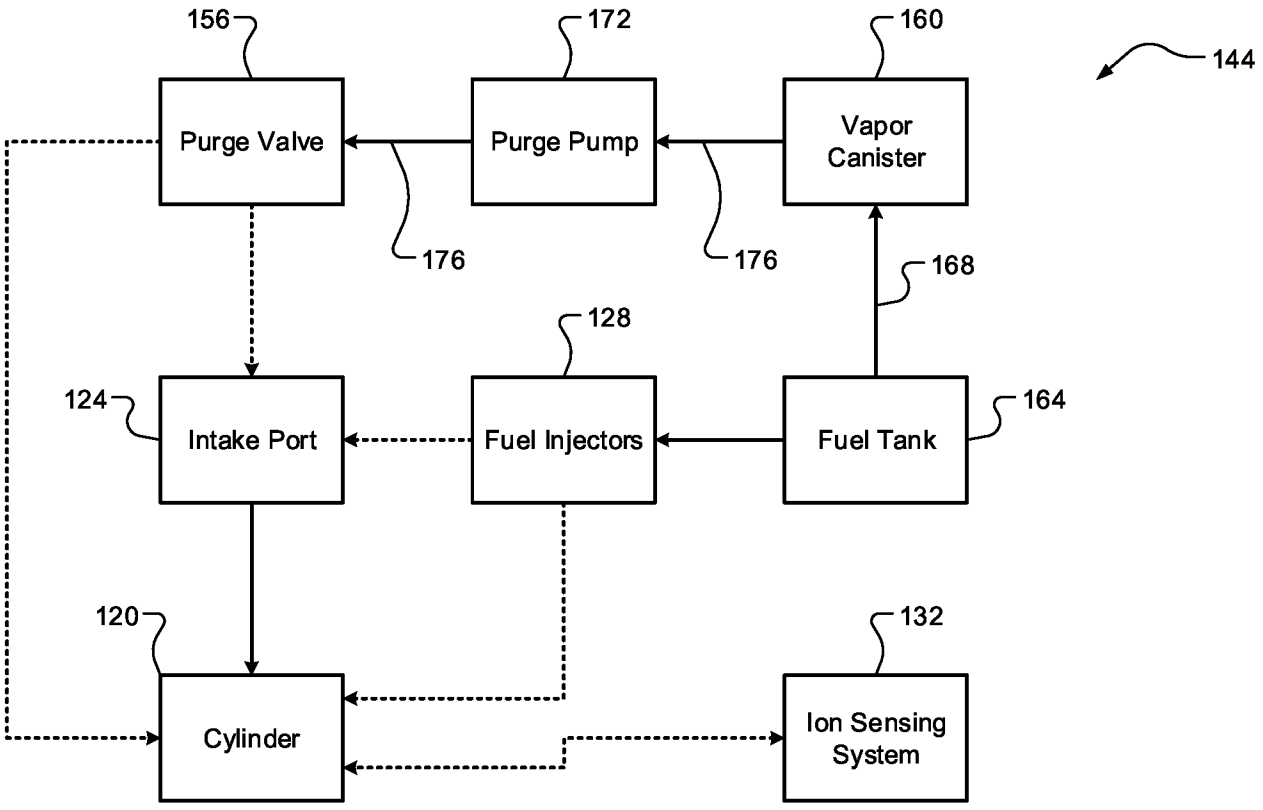
FIG. 2 is a functional block diagram of an example configuration of the EVAP system according to the principles of the present disclosure.

Referring now to FIG. 2, a functional block diagram of an example configuration of the EVAP system 144 is illustrated. While the EVAP system 144 is only shown with respect to a single intake port 124 and single cylinder 120 of the engine 104, it will be appreciated that the fuel vapor could be supplied to all of the intake ports 124 and/or cylinders 120. The EVAP system 144 is configured to deliver fuel vapor to the intake ports 124 of the engine 104 via purge valves 156. For example, the purge valves 156 could be disposed within holes or apertures in a wall of the intake ports 124. As previously mentioned, it will be appreciated that the purge valves 156 could be configured to deliver the fuel vapor directly to the cylinders 120, e.g., via different holes or apertures. One example of the purge valves is a butterfly-type valve, but it will be appreciated that any suitable valve configured to regulate the flow of pressurized fuel vapor could be utilized.

The EVAP system 144 also includes a vapor canister 160 that traps fuel vapor that evaporates from liquid fuel stored in a fuel tank 156. This fuel vapor can be directed from the fuel tank 164 to the vapor canister 160 via an evaporation line or duct 168. In one exemplary implementation, the vapor canister 160 includes (e.g., is lined with) activated carbon (e.g., charcoal) that adsorbs the fuel vapor. While not shown, the vapor canister 160 could further include a vent device (e.g., a valve) that allows fresh air to be drawn through the vapor canister 160, thereby pulling the trapped fuel vapor with it. As previously discussed, conventional EVAP systems utilize engine vacuum to draw this fresh air (and trapped fuel vapor) through the system for engine delivery. In the illustrated EVAP system 144, an optional purge pump 172 is configured to selectively pump the fuel vapor from the vapor canister 160 through vapor lines 176 to the intake ports 124 (via the purge valves 156).

This pumping could be in conjunction with or without the use of drawn fresh air through the vapor canister 160. The purge pump 172 could be any suitable pump configured to pump the fuel vapor from the vapor canister 160 through vapor lines 176. Engine vacuum could also be utilized to draw fuel vapor. In the conventional EVAP systems described herein, the HC sensor would typically be disposed in the vapor lines 176 and would be configured to measure an amount of HC in the fuel vapor pumped by the purge pump 172. In the illustrated example configuration of the EVAP system 144, however, there is no HC sensor and instead the ion sensing system 132 is utilized to measure in-cylinder FAR for open-loop lambda control during engine cold starts before closed-loop lambda control is available. This could include, for example, the controller 140 adjusting the purge valves 156, the purge pump 172, and/or the fuel injectors 124.

As the purge valves 156 regulate the flow of the fuel vapor into the engine 104, the controller 148 is configured to control at least one of the purge pump 172 and the purge valves 156 to deliver the fuel vapor to the engine 104. The control of the purge pump 172 could include controlling its rotational speed. The control of the purge valves 156, on the other hand, could include controlling their angular opening. For example, there may be a high amount of HC present in highly pressurized fuel vapor in the vapor lines 176, and thus the controller 148 may primarily actuate the purge valves 156 to deliver the fuel vapor to the engine 104. In many situations, however, the controller 160 will perform coordinated control of both the purge pump 172 and the purge valves 156 to deliver the fuel vapor to the engine 104. For example only, when actuation of the purge pump 172 and the purge valves 156 is inadequate for maintaining stoichiometric operation of the engine 104, pulse widths of the fuel injectors 124 could then be adjusted.

Figure 3:
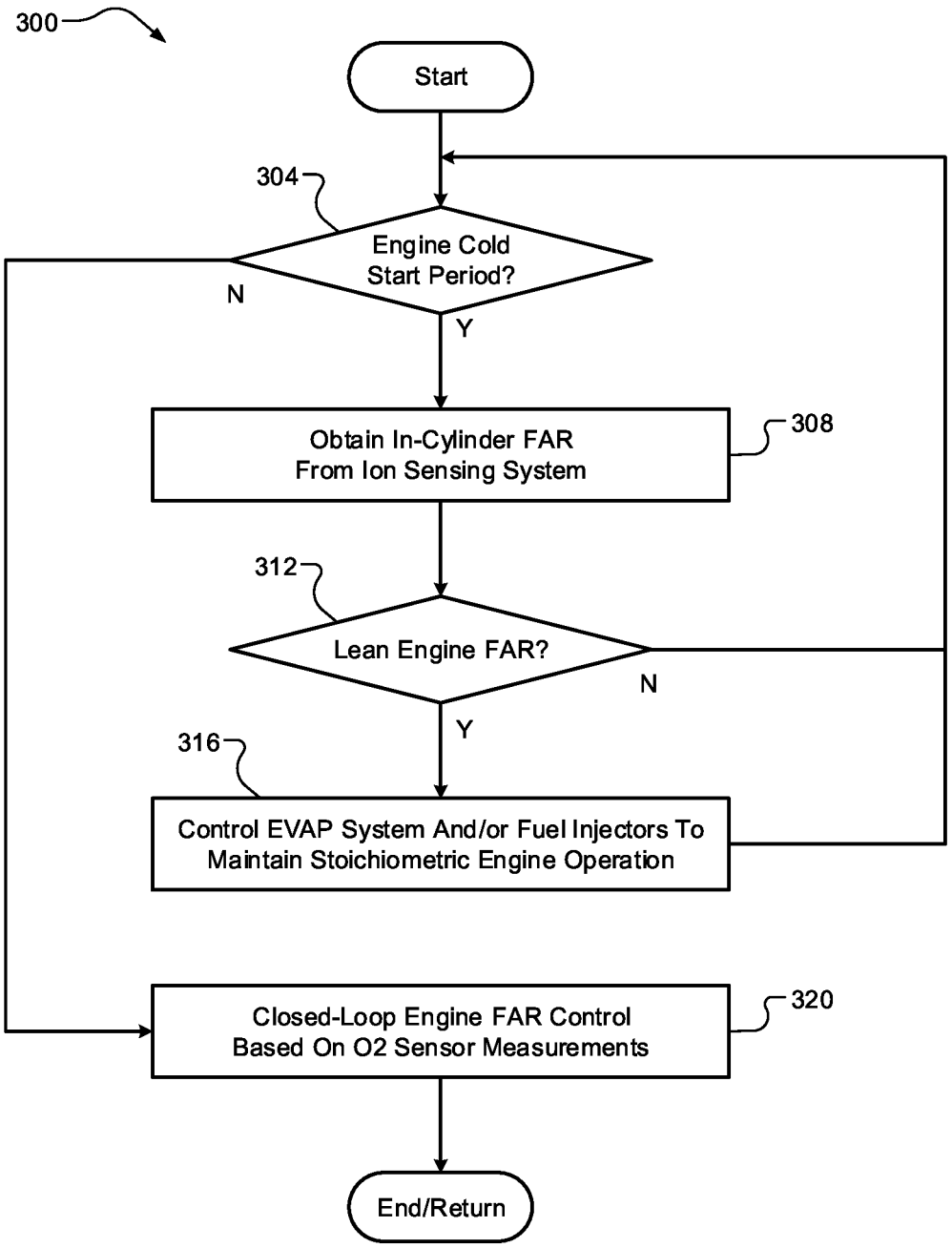
FIG. 3 is a flow diagram of an example method for controlling an EVAP system during and after engine cold starts according to the principles of the present disclosure.

Referring now to FIG. 3, a flow diagram of an example EVAP control method 300 according to the principles of the present disclosure is illustrated. At 304, the controller 148 determines whether an engine cold start has been initiated. This is also referred to herein as an "engine cold start period." This engine cold start period represents an initial period after cold starting the engine 104 (e.g., approximately 5-10 seconds) during which the O2 sensor(s) 144 have not yet reached their ideal or acceptable operating temperatures for accurate measurement as part of closed-loop FAR control of the engine 104. When true, the method 300 proceeds to 308. Otherwise, the method 300 proceeds to 320. At 308, the controller 148 obtains measured in-cylinder FAR from the ion sensing system 132. It will be appreciated that the determination of the in-cylinder FAR could also include processing of the signals/data provided by the ion sensing system 132.

At 312, the controller 148 compares the measured in-cylinder FAR to a target FAR. When this comparison indicates lean FAR engine operation, the method 300 proceeds to 316. Otherwise, airflow control could be performed to lean the engine FAR or the comparison could indicate stoichiometric operation and the method 300 returns to 304. At 316, the controller 148 adjusts operation of the EVAP system 144 and/or the fuel injectors 124 to enrich the engine FAR and maintain stoichiometric engine operation. In one exemplary implementation, the controller 148 first attempts to provide fuel vapor to the engine 104 from the EVAP system 144 (e.g., by controlling the purge valve(s) and/or the purge pump 172) and, if this is insufficient, the controller 148 then adjusts (e.g., increases) pulse widths of the fuel injectors 124. The method 300 then returns to 304. At 320 (i.e., after the engine cold start period), the controller 148 transitions to closed-loop lambda control of the engine 104 based on feedback from the one or more O2 sensors 144. It will be appreciated that ion sensing system based lambda control could also be utilized in conjunction with the O2 sensor based lambda control. The method 300 then ends or returns to 304.

As previously discussed, it will be appreciated that the term "controller" as used herein refers to any suitable control device or set of multiple control devices that is/are configured to perform at least a portion of the techniques of the present disclosure. Non-limiting examples include an application-specific integrated circuit (ASIC), one or more processors and a non-transitory memory having instructions stored thereon that, when executed by the one or more processors, cause the controller to perform a set of operations corresponding to at least a portion of the techniques of the present disclosure. The one or more processors could be either a single processor or two or more processors operating in a parallel or distributed architecture.

It should be understood that the mixing and matching of features, elements, methodologies and/or functions between various examples may be expressly contemplated herein so that one skilled in the art would appreciate from the present teachings that features, elements and/or functions of one example may be incorporated into another example as appropriate, unless described otherwise above.

What is claimed is:

1. An evaporative emissions (EVAP) system for an engine of a vehicle, the EVAP system comprising:

an ion sensing system configured to measure a fuel/air ratio (FAR) within cylinders of the engine; and a controller configured to:

during an engine cold start period, perform open-loop lambda control of the engine including (i) obtaining, from the ion sensing system, the measured FAR within the cylinders of the engine, (ii) comparing the measured FAR within the cylinders of the engine to a target FAR within cylinders of the engine, and (iii) based on the comparing, adjusting operation of at least one of the EVAP system and fuel injectors of the engine to maintain a stoichiometric operation of the engine; and during a normal engine operation period following the engine cold start period, (i) transitioning the use of the ion sensing system to only be used for engine knock mitigation and (ii) performing closed-loop lambda control of the engine based on measurements from one or more oxygen (O2) sensors in an exhaust treatment system of the engine;

wherein the use of the ion sensing system for open-loop lambda control of the engine eliminates the need for a hydrocarbon (HC) sensor in the EVAP system;

wherein the engine cold start period is defined from a start of the engine until the one or more O2 sensors in the exhaust treatment system of the engine have reached an acceptable temperature;

wherein the EVAP system further comprises:

a vapor canister that stores fuel vapor and one or more purge valves proximate to the cylinders of the engine that control the flow of fuel vapor from the vapor canister to the engine; and a purge pump configured to pump the fuel vapor from the vapor canister to the engine via the one or more purge valves;

wherein the controller is configured to maintain stoichiometric operation of the engine by controlling the one or more purge valves to deliver fuel vapor to the engine and, wherein during the engine cold start period, the controller is configured to perform the open-loop control of a FAR of exhaust gas produced by the engine by further controlling the purge pump based only on measurements from the ion sensing system.

2. The EVAP system of claim 1, wherein the controller is configured to maintain stoichiometric operation of the engine by controlling pulse widths of the fuel injectors when fuel vapor delivery by the EVAP system is insufficient for maintaining stoichiometric operation of the engine.

3. The EVAP system of claim 1, wherein the engine is a twin-turbocharged six-cylinder engine.

4. A method for controlling an evaporative emissions (EVAP) system of an engine of a vehicle during and after engine cold starts, the method comprising:

detecting, by a controller of the vehicle, an engine cold start period;

in response to detecting a start of the engine cold start period, performing, by the controller, open-loop lambda control of the engine including (i) obtaining, by the controller and from an ion sensing system, a measured fuel/air ratio (FAR) within the cylinders of the engine, (ii) comparing, by the controller, the measured FAR within the cylinders of the engine to a target FAR within cylinders of the engine, and (iii) based on the comparing, adjusting, by the controller, operation of at least one of the EVAP system and fuel injectors of the engine to maintain a stoichiometric operation of the engine; and in response to detecting an end of the engine cold start period and a start of a normal engine operation period, (i) transitioning the use of the ion sensing system to only be used for engine knock mitigation and (ii) performing closed-loop lambda control of the engine based on measurements from one or more oxygen (O2) sensors in an exhaust treatment system of the engine, wherein using the ion sensing system for open-loop lambda control of the engine eliminates the need for a hydrocarbon (HC) sensor in the EVAP system;

wherein the engine cold start period is defined from a start of the engine until the one or more O2 sensors in the exhaust treatment system of the engine have reached an acceptable temperature;

wherein the EVAP system further comprises:

a vapor canister that stores fuel vapor and one or more purge valves proximate to the cylinders of the engine that control the flow of fuel vapor from the vapor canister to the engine; and a purge pump configured to pump the fuel vapor from the vapor canister to the engine via the one or more purge valves;

wherein maintaining stoichiometric operation of the engine comprises controlling, by the controller, the one or more purge valves to deliver fuel vapor to the engine; and wherein during the engine cold start period, the controller is configured to perform the open-loop control of a FAR of exhaust gas produced by the engine by further controlling the purge pump based only on measurements from the ion sensing system.

5. The method of claim 4, wherein maintaining stoichiometric operation of the engine comprises controlling, by the controller, pulse widths of the fuel injectors when fuel vapor delivery by the EVAP system is insufficient for maintaining stoichiometric operation of the engine.

6. The method of claim 4, wherein the engine is a twin-turbocharged six-cylinder engine.

* * * * *